US011325338B2

(12) United States Patent
Boegli et al.

(10) Patent No.: US 11,325,338 B2
(45) Date of Patent: May 10, 2022

(54) PAPER JOINT WITHOUT DISCONTINUITY FOR TUBE SHAPED PAPER WRAPS CLOSED BY MEANS OF EMBOSSED PAPER AND RE-SEALABLE INNERLINER SEAL BY MEANS OF STRUCTURED INNERLINER

(71) Applicant: BOEGLI-GRAVURES SA, Marin-Epagnier (CH)

(72) Inventors: Charles Boegli, Marin-Epagnier (CH); Alain Droz, Marin-Epanier (CH); Werner Steffen, Stans (CH)

(73) Assignee: BOEGLI-GRAVURES SA, Marin-Epagnier (CH)

( * ) Notice: Subject to any disclaimer, the term of this patent is extended or adjusted under 35 U.S.C. 154(b) by 491 days.

(21) Appl. No.: 16/338,856

(22) PCT Filed: Oct. 2, 2017

(86) PCT No.: PCT/IB2017/056063
§ 371 (c)(1),
(2) Date: Apr. 2, 2019

(87) PCT Pub. No.: WO2018/065879
PCT Pub. Date: Apr. 12, 2018

(65) Prior Publication Data

US 2021/0276298 A1 Sep. 9, 2021

(30) Foreign Application Priority Data

Oct. 3, 2016 (EP) ..... 16192062

(51) Int. Cl.
*B31F 1/07* (2006.01)
*A24C 5/00* (2020.01)
(Continued)

(52) U.S. Cl.
CPC ..... *B31F 1/07* (2013.01); *A24C 5/005* (2013.01); *B31B 50/62* (2017.08); *B31F 5/02* (2013.01);
(Continued)

(58) Field of Classification Search
CPC ... B31F 1/07; B31F 5/02; B31B 50/62; A24C 5/005; B65D 85/10
See application file for complete search history.

(56) References Cited

U.S. PATENT DOCUMENTS 3,378,187 A * 4/1968 Sherrill ..... B65D 5/0227 206/264
4,480,644 A * 11/1984 Luke ..... A24C 5/24 131/365
(Continued)

FOREIGN PATENT DOCUMENTS

AU 772613 B2 5/2004
CA 2382597 A1 11/2000
(Continued)

OTHER PUBLICATIONS

International Search Report for PCT/IB2017/056063, dated May 4, 2018, 3 pages.
(Continued)

*Primary Examiner* — Andrew M Tecco
*Assistant Examiner* — Nicholas E Igbokwe
(74) *Attorney, Agent, or Firm* — Nixon & Vanderhye P.C.

(57) ABSTRACT

A set of thin foil surfaces configured to achieve a joint among the foil surfaces, the joint being arranged to be without discontinuity, comprising at least a first portion of surface dedicated to achieve the joint; pixelized type embossings on the first portion of surface; and at least a second portion of surface dedicated to achieve the joint. The second portion of surface is shaped to correspond to the first
(Continued)

portion of surface for making the joint between the first portion of surface and the second portion of surface through contact.

18 Claims, 13 Drawing Sheets

(51) Int. Cl.
*B31B 50/62* (2017.01)
*B31F 5/02* (2006.01)
*B65D 85/10* (2006.01)

(52) U.S. Cl.
CPC ..... *B65D 85/10* (2013.01); *B31B 2241/003* (2013.01); *B31F 2201/0743* (2013.01); *B31F 2201/0764* (2013.01)

(56) References Cited

U.S. PATENT DOCUMENTS 5,007,271 A * 4/1991 Boegli ..... B21D 13/04 156/206
5,061,535 A 10/1991 Kreckel et al.
5,598,774 A 2/1997 Boegli
5,846,636 A * 12/1998 Ruppel ..... B31F 1/07 428/154
6,176,819 B1 * 1/2001 Boegli ..... B31F 1/07 493/194
6,665,998 B1 12/2003 Boegli
6,715,411 B1 4/2004 Boegli
7,036,347 B2 5/2006 Boegli
7,147,453 B2 12/2006 Boegli
7,229,681 B2 6/2007 Boegli
8,038,922 B2 10/2011 Boegli
8,430,663 B2 4/2013 Boegli
8,495,900 B2 7/2013 Boegli
8,932,044 B2 1/2015 Boegli
9,140,834 B2 9/2015 Boegli
9,156,107 B2 10/2015 Boegli et al.
9,180,643 B2 11/2015 Boegli
9,481,141 B2 11/2016 Boegli
9,505,167 B2 11/2016 Boegli
9,579,924 B2 2/2017 Boegli
9,636,885 B2 5/2017 Boegli et al.
9,809,927 B2 11/2017 Boegli
9,939,725 B2 4/2018 Boegli et al.
9,993,895 B2 6/2018 Boegli et al.
10,083,253 B2 9/2018 Boegli et al.
10,183,318 B2 1/2019 Boegli et al.
2005/0279147 A1 12/2005 Boegli
2006/0278357 A1 * 12/2006 Suzuki ..... B31F 1/07 162/117
2007/0161485 A1 7/2007 Penne
2009/0226670 A1 * 9/2009 Schutz ..... D21H 27/02 428/154
2010/0061619 A1 3/2010 Boegli
2011/0024947 A1 2/2011 Schulz et al.
2012/0018993 A1 1/2012 Boegli et al.
2012/0292821 A1 11/2012 Boegli
2013/0069276 A1 * 3/2013 Boegli ..... B31F 1/07 264/293
2013/0093117 A1 * 4/2013 Griesmayr ..... A24C 5/005 264/293
2014/0059977 A1 3/2014 Boegli
2015/0027083 A1 * 1/2015 Polloni ..... B65B 19/228 53/131.4
2016/0075077 A1 3/2016 Boegli et al.
2017/0066079 A1 3/2017 Reisse et al.
2017/0282635 A1 10/2017 Boegli et al.
2018/0220698 A1 8/2018 Boegli et al.
2018/0370175 A1 12/2018 Boegli et al.

FOREIGN PATENT DOCUMENTS

CA 2367423 C 5/2008
DE 202017105458 U1 12/2017
EP 2366637 A1 9/2011
EP 2572820 A1 3/2013
EP 2653301 A1 10/2013
EP 2842730 A1 3/2015
EP 3300612 A1 4/2018
EP 3415306 A1 12/2018
GB 1400743 A 7/1975
RU 2346818 C2 2/2009
RU 2592195 C2 7/2016
WO 99/25547 A1 5/1999
WO 2007/012215 A1 2/2007
WO 2013/120916 A1 8/2013
WO 2013/156256 A1 10/2013
WO 2017/208092 A1 12/2017

OTHER PUBLICATIONS

Written Opinion of the ISA for PCT/IB2017/056063, dated May 4, 2018, 5 pages.
Search Report dated Nov. 10, 2020, issued in Russian Federation Application No. 2019111642/03(022627), 2 pages.
Inquiry under the substantive examination dated Nov. 17, 2020, issued in Russian Federation Application No. 2019111642/03(022627), 5 pages.

* cited by examiner

PAPER JOINT WITHOUT DISCONTINUITY FOR TUBE SHAPED PAPER WRAPS CLOSED BY MEANS OF EMBOSSED PAPER AND RE-SEALABLE INNERLINER SEAL BY MEANS OF STRUCTURED INNERLINER

This application is the U.S. national phase of International Application No. PCT/IB2017/056063 filed 2 Oct. 2017, which designated the U.S. and claims priority to EP Patent Application No. 16192062.4 filed 3 Oct. 2016, the entire contents of each of which are hereby incorporated by reference.

TECHNICAL FIELD

The present invention is in the field of paper and innerliner joints and methods for manufacturing paper and innerliner joints. More particularly the invention applies to paper and innerliner products for the tobacco industry.

BACKGROUND OF THE INVENTION

Introduction

Packaging foils for the tobacco industry or for the food industry have already for some time been embossed with embossing-roll devices, wherein, for example, so-called innerliners, which are wrapped around a number of cigarettes, or packaging material for chocolate, butter or similar foods, electronic components, jewelry or watches can be involved.

In WO 2013/156256 A1 to the same applicant, in order to achieve the general object of specifying a method for producing a set of embossing rolls with which it is possible to carry out fine embossing for the extremely different surface structures described therein of the specified materials of an extremely wide range of types in the online operation of a packaging system, it is proposed that, in a male/female embossing roll system, the female embossing surface structure be produced independently of a previously produced or physically already existing male embossing surface structure.

In the case of fine structures, this statement is sufficient, since this type of production permits a very large multiplicity of possible designs.

If, however, relatively larger freely shaped surfaces of logos are involved, their embossing with a satisfactory aesthetic quality is problematic. In order that these surfaces, for example in the case of innerliners, have the same reflectivity everywhere, the same specific embossing pressure must be applied everywhere. However, this is not possible without suitable measures if there are extremely small local deviations of the geometry between male embossing and female embossing rolls, which allow the local embossing pressure to vary highly. Given excessively close tolerances and high pressures, the embossing produces holes. High pressures can impair the sandwich structure of an innerliner which, at elevated temperatures, leads to its degradation, in that varnish blotching arises on the rear side of the paper.

The solution proposed in EP 2 842 730 A1 to the same applicant, to provide the surfaces and/or side faces of the logo with facets, provides a substantial improvement in the pressing quality for a number of substrates.

Starting from this prior art, the present invention makes use of paper or innerliner material embossed with an embossing device with an embossing roller set having one male embossing and female embossing rolls each cooperating with each other, which not only permits fine embossing to be carried out for the extremely different surface structures described of the specified materials of an extremely wide range of types in the online operation of a packaging system, but, furthermore, to carry out high-quality fine embossing.

Extending the research presented in EP 2 842 730 A1, the present application explores aspects unknown to this day relative to the embossing described therein, whereby these aspects concern adhesive properties of the obtained embossed structures that will be illustrated herein below in FIGS. 4 to 8.

These adhesive properties offer new solutions for a new type of seal that may be of use notably in the tobacco industry.

In the following we will first describe an overview of the prior art understanding of mechanical adhesion. This will help to understand the mechanical adhesion for cigarette paper achieved using specific embossed structures known from another context, that will thereafter be described in reference to FIGS. 4 to 8.

Adherence of Paper

One problem addressed by the present invention is that of joints between two surfaces of paper, more particularly joints which need to be manufactured to be permanent and without discontinuity across the joints.

The most common manner to make joints today is to use glue, and there are specific types of glue for specific type of joints.

Many alternative techniques have been developed to make joints on specific papers. For example the sealing of a letter may be realized by means of a so-called touch-and-close fastener, which may be opened and closed a plurality of times until the adherence of the touch-and-close fastener diminishes. There are other examples for joints that do without conventional glue and instead make use of thermoplastic fibers or filaments—see for example US publication US 4,480,644.

Modern joint technologies are based on the adhesive or attaching forces. These forces may be attributed to the physical state of a border surface layer that occurs between two condensed phases that are in contact, i.e., between solids and liquids having a negligible vapor pressure. The main property of this physical state is the mechanical cohesion between the two phases, that is caused by molecular interactions in the border surface layer. The forces that cause the mechanical cohesion have not yet entirely been elucidated, and many different theories exist for adherence phenomena.

It is usually distinguished between mechanical adherence caused by physical-mechanical forces, and specific adherence caused by forces that find their origin in chemical, physical and thermodynamic reasons, each for which there exists a number of different adherence theories. These theories have been individually set up, but according to the present state of knowledge, the mechanical and specific adherence form a unity.

Mechanical Adherence

The theory of mechanical adherence refers to an intermingling of a glue in the small microscopic pores and recesses of a solid body. While this formerly was the only explanation for adherence, it could not answer the question why there is a cohesion between a solid with a smooth surface and glue.

Despite the fact that there is no exact scientific explanation, the inventor succeeded in making a new joint mechanism, which works with or without glue.

The case use without glue may be used for seals that need to be opened and closed repeatedly, whereby the word repeatedly applies to specific scenarios of use.

Furthermore, there are sealable paper surfaces, i.e., the term adherence joints will be used in the following to name special types of adherence joints, since nowadays a plurality of physical/chemical methods are being used for adherent joints—depending on the actual use.

Tightness of a Package

In the context of the tobacco industry products that will be considered herein, this technical term refers to the hermetical properties of a package and thus the joints used therein, required for reasons of hygiene, preservation of taste and freshness when using tight re-sealable packages.

SUMMARY OF THE INVENTION

In a first aspect, the invention provides a set of thin foil surfaces configured to achieve a joint among the foil surfaces, the joint being arranged to be without discontinuity, comprising at least a first portion of surface dedicated to achieve the joint; pixelized type embossings on the first portion of surface; and at least a second portion of surface dedicated to achieve the joint. The second portion of surface is shaped to correspond to the first portion of surface for making the joint between the first portion of surface and the second portion of surface through contact.

In a preferred embodiment, the second portion of surface comprises pixelized type embossings, whereby the pixelized type embossings of the first portion of surface and the pixelized type embossings of the second portion of surface are configured to intertwine for achieving the joint between the first portion of surface and the second portion of surface.

In a further preferred embodiment, the second portion of surface comprises an adhesive layer, whereby the pixelized type embossings of the first portion of surface and the adhesive layer of the second portion of surface are configured to intertwine for achieving the joint between the first portion of surface and the second portion of surface.

In a further preferred embodiment, the set of thin foil surfaces further comprises a layer of glue configured to be located on either one of the first portion of surface or the second portion of surface such to be positioned between the first portion of surface and the second portion of surface at the time when the joint is to be made.

In a further preferred embodiment, the thin foil is a sheet of paper delimited by two opposed substantially parallel borders; the first portion of surface corresponds to a first of the parallel borders; the second portion of surface corresponds to a second of the parallel borders, opposed to the first parallel border. The sheet of paper is configured to form a tube-shaped closed wrapper at a time when the first portion of surface is in contact with the second portion of surface to make the joint.

In a further preferred embodiment, the thin foil is a sheet of cigaret paper.

In a further preferred embodiment, The set of thin foil surfaces further comprises a hinged adhesive label closing comprising the second portion of surface; an innerliner of a package comprising the first portion of surface. The adhesive label is configured to close an opening in the innerliner by means of the joint.

In a further preferred embodiment, the embossing of pixelized type embossings on the first portion of surface is configured such that a mean value of amplitude of roughness of the pixelized type embossings increases from a remote part of the first portion of surface located under the adhesive label remote from a border of the adhesive label towards a border part of the first portion of surface located between the border of the adhesive label and the remote part.

In a further preferred embodiment, the pixelized type embossings have heights in a range of 4 μm to 250 μm.

In a second aspect, the invention provides a method for making a joint without discontinuity between surfaces of thin foil. The method comprises steps of embossing pixelized type embossings on a first portion of surface of thin foil; position the first portion of surface against a second portion of surface of thin foil; pressing the first portion of surface against the second portion of surface such to achieve the joint; and adjusting a pressure of the pressing to achieve the joint with a thickness substantially the same as a thickness of the thin foil.

In a further preferred embodiment, the method further comprises embossing pixelized type embossings on the second portion of surface. The pixelized type embossings of the first portion of surface and the pixelized type embossings of the second portion of surface are configured to intertwine for achieving the joint between the first portion of surface and the second portion of surface during the step of pressing.

In a further preferred embodiment, the method further comprises providing an adhesive layer on the second portion of surface. The pixelized type embossings of the first portion of surface and the adhesive layer of the second portion of surface are configured to intertwine for achieving the joint between the first portion of surface and the second portion of surface during the step of pressing, the joint being re-sealable.

In a further preferred embodiment, the thin foil is a sheet of paper delimited by two opposed substantially parallel borders; the first portion of surface corresponds to a first of the parallel borders; the second portion of surface corresponds to a second of the parallel borders, opposed to the first parallel border. The method further comprises forming the sheet of paper into a tube-shaped closed wrapper by contacting the first portion of surface with the second portion of surface to make the joint.

In a further preferred embodiment, the thin foil is a sheet of cigaret paper.

In a further preferred embodiment, the method further comprises steps of providing a hinged adhesive label closing comprising the second portion of surface; providing an innerliner of a package comprising the first portion of surface; and configuring the adhesive label to close an opening in the innerliner by means of the joint.

In a further preferred embodiment, the embossing of pixelized type embossings on the first portion of surface comprises increasing a mean value of amplitude of roughness of the pixelized type embossings from a remote part of the first portion of surface located under the adhesive label remote from a border of the adhesive label towards a border part of the first portion of surface located between the border of the adhesive label and the remote part.

In a further preferred embodiment, the pixelized type embossings have heights in a range of 4 μm to 250 μm.

BRIEF DESCRIPTION OF THE FIGURES

The invention will be better understood through the description of preferred embodiments, an in reference to the drawings, wherein FIG. 1 contains a schematic representation of steps involved to make cigarettes according to prior art.

DETAILED DESCRIPTION OF PREFERRED EMBODIMENTS

Pixelization Embossing

The present section provides details concerning the technology of pixelization embossing. The result of pixelization embossing is a non-regular, i.e., non periodic occurrence of embossed light scattering structures. The overall size of the light scattering structures is however in a predetermined range as defined by the tool used in the pixelization embossing process. In other words, pixelization embossing is not designed to create distinct rows of embossed structures. Hence a surface that has been subject to a pixelization embossing process may alternatively be described to be roughened surface, for example in the 10 μm height range, wherein the surface structures have sizes that remain in the predetermined range.

Figure 7A:
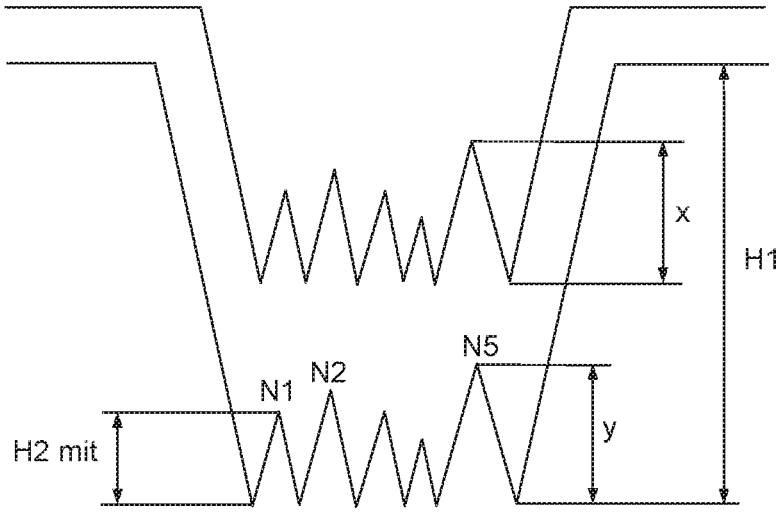
FIG. 7A shows a schematic representation of an embossing including fine pixelization being made according to a preferred embodiment.
Figure 7B:
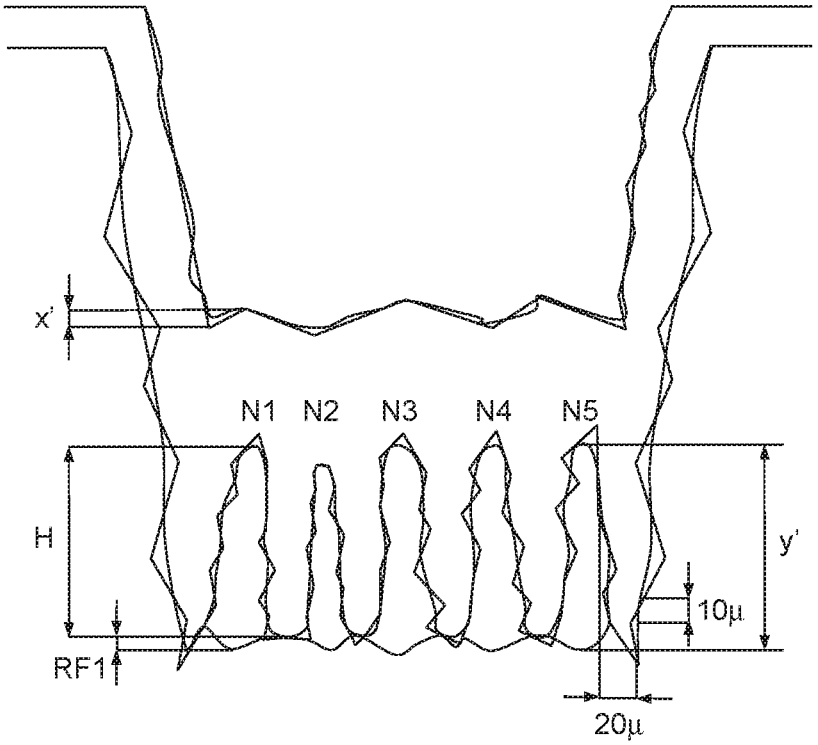
FIG. 7B shows a schematic representation of an embossing including fine pixelization being made according to a preferred embodiment.
Figure 8A:
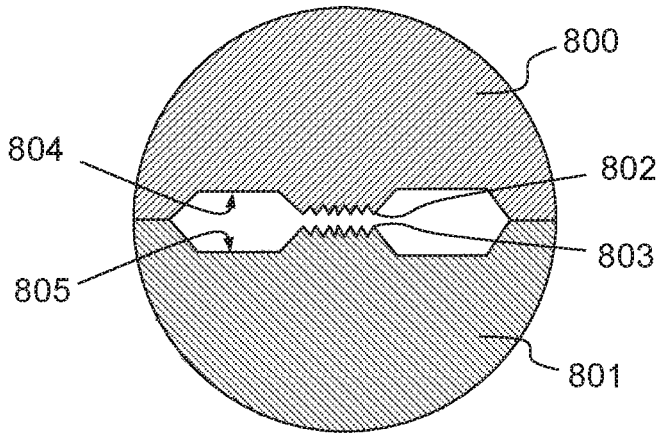
FIGS. 8A and 8B show an example structure to be provided for fine pixelization embossing according to a preferred embodiment.
Figure 8B:
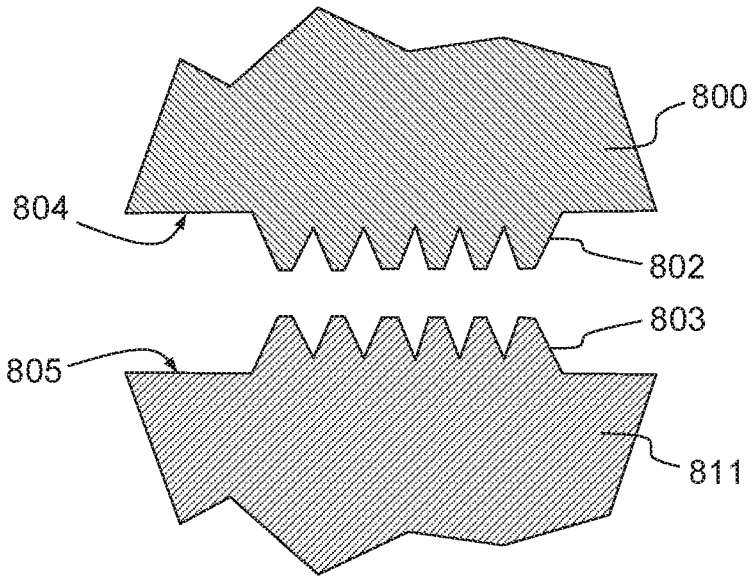

The implementation of this technology will herein be illustrated through 2 example embodiments, a first example making use of elevated/recessed structures which respectively carry light scattering elements (FIGS. 4-7B), and a second example designed to work without any elevated/recessed structures, but instead uses only light scattering elements on two cooperating rollers (FIGS. 8A-8B). Both examples may notably be used for achieving esthetic effects.

Figure 4:
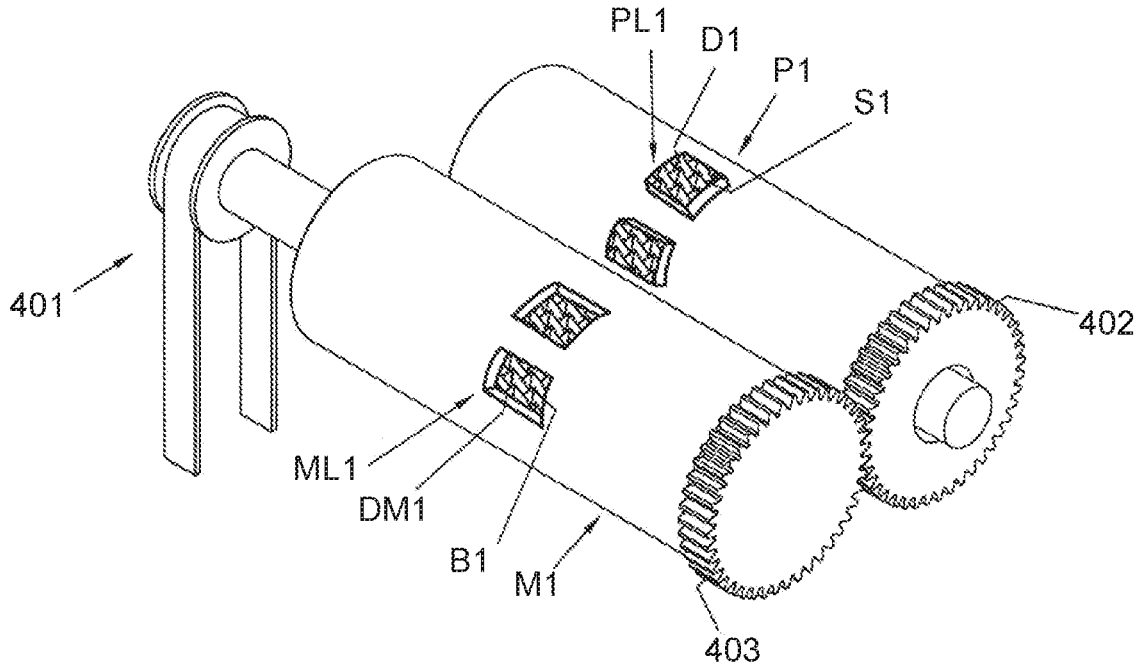
FIG. 4 contains a schematic illustration of a set-up for embossing pixelized embossings.

FIG. 4 shows, schematically and simplified, a structure of an embossing device having a male embossing roll P1 and a female embossing roll M1, wherein the female embossing roll is driven by a drive 401. The drive force of the female embossing roll M1 on the male embossing roll P1 is provided via a fine gear mechanism 402, 403. The male embossing roll P1 has some structural elements PL1, which are elevated, and the female embossing roll M1 has recessed structural elements ML1 assigned to the male embossing structural elements PL1. The structures of the female embossing roll are produced independently of the structures of the male embossing roll, for example by means of a laser system, and are therefore non-inversely congruent, by which means they are given improved contrast. In the current prior art, however, other types of production such as engraving, etching or milling are possible.

Figure 5:
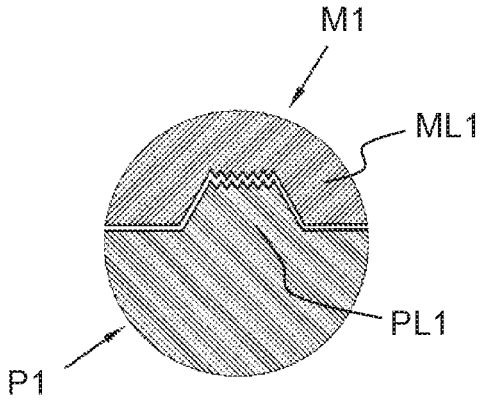
FIG. 5 contains a schematic illustration of embossing structures for pixelized embossings.

FIG. 5 shows a section through two structural elements PL1, ML1 that are assigned to each other. For simplicity, here the light-scattering elements on top of structural element PL1 and in the recess formed by structural element ML1 are designed as square pyramids. The light-scattering elements ultimately produce the pixelized embossing.

Figure 6A:
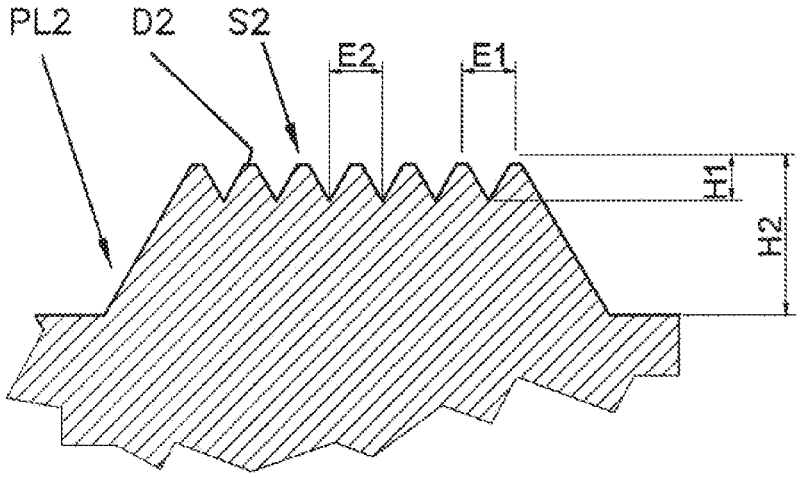
FIG. 6A shows a schematic representation of male embossing structures including fine pixelization.
Figure 6B:
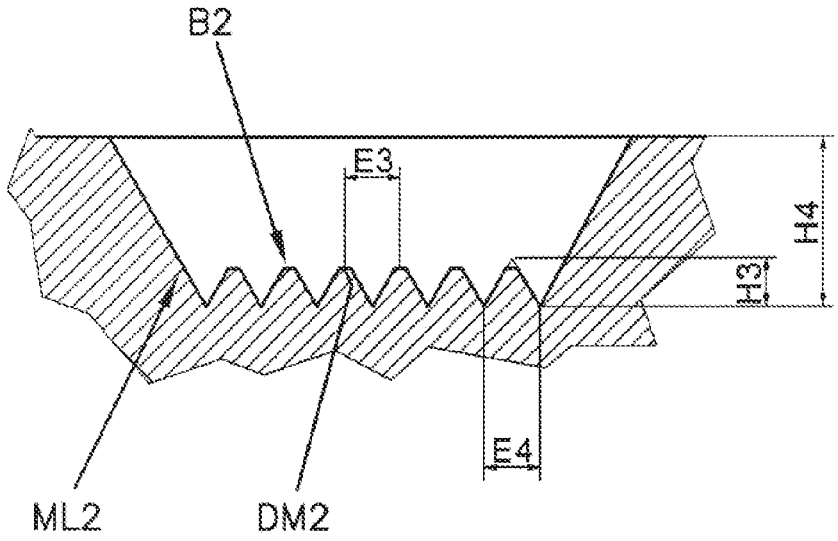
FIG. 6B shows a schematic representation of female embossing structures including fine pixelization.

FIGS. 6A and 6B show an example preferred embodiment of male structural element PL2 (FIG. 6A) and female structural element ML2 (FIG. 6B). In FIG. 6A light-scattering elements D2 of the male embossing roller are flattened pyramids with a square base and a peak spacing E1, a foot width E2 and a height H1. The overall height of the male embossing structural element is H2. The latter overall height H2 is chosen in correspondence with a thickness of the material to be embossed. In FIG. 6B the dimensions for light-scattering elements DM2 of the female embossing structural element ML2, E3, E4, H3, H4 are slightly different from those of the associated male embossing structural element of FIG. 6A. The height H2 of the latter is dimensioned such to penetrate in the recess H4 of the female element. H3 represents the size of microstructures/light scattering elements to be embossed. The light scattering elements D2 and DM2 are the structures that make the pixelized embossing.

The light-scattering elements, instead of being formed in the shape of pyramids with a square, may also be formed with a rectangular or another cross section, or have a conical, half-round or half-moon shape or any other shape.

As emerges from the following figure descriptions, the light-scattering elements can be arranged either only on the male embossing structural elements or only on the female embossing structural elements or on both structural elements or on all or individual side surfaces of the structures or around structures.

In a departure from the idealized representation of the light-scattering elements in FIGS. 6A and 6B, in FIG. 7A the structural elements and light-scattering elements are also illustrated schematically but rather more as actually produced, that is to say taking into account the fabrication tolerances. Here, H1 designates the overall depth of a female embossing structural element, H2*mit* the average and y the maximum height of the light-scattering elements N1-N5. In this example, the overall depth H1 varies in a range around 250 μm, and the average height H2*mit* of the light-scattering elements N1-N5 around 50 μm. The overall depth H1 of the female embossing structural element can be between 25 μm and 400 μm. The associated male embossing structural element is likewise indicated with the maximum height x of a light-scattering element. The height of the associated male embossing structure is of the same order of magnitude as the depth of the female embossing structural element.

In FIG. 7B, the roughness of the roll steel and the fabrication tolerances are drawn by way of example on an enlarged scale. Here, RF1 and x' denote the maximum roughness values of the female embossing and male embossing structural elements in micrometers, which are here assumed to lie between 3 μm and 5 μm. H is the average height of the light-scattering elements N1 to N5, which means the arithmetic means of all five elements assumed here lies around 50 μm.

N is an exemplary number of elements, which can be equal or different in the two coordinate directions.

In order that the light-scattering elements meet the requirements, the following conditions should be fulfilled:

1. The pressing surfaces on the uppermost surface, must be flat and sufficiently large but not too large, in order to ensure a usable imprint;
2. the foot width=cross-sectional diameter at the base of the light-scattering elements, or the side length of the light-scattering elements, must be at least 10 μm;
3. the height Hk (see formula for this below) of the light-scattering elements should be between 10 μm and 80 μm with small step length=pitch or period of the engraving of the light-scattering elements of 80 μm and 200 μm; and
4. the height Hg (see formula for this below) of the light-scattering elements should be between 80 μm and 150 μm with step length between 200 μm and 450 μm;
5. the number of light-scattering elements N in regular M/F structures must be at least equal to 2 per structural element, N=[2, 3, 4, . . . ]; and
6. the heights and number of light-scattering elements in free M/F structures is like c) or d) and e), according to design requirement.

Here:

$$Hk=Rf1+H+x'$$

$$Hg=Rf1+H+x'$$

H is the average height (=arithmetic mean formed from all heights belonging to N1, N2, . . . ).

FIGS. 8A and 8B relate to a second example of embossing that allows to produce pixelized embossed surfaces.

FIG. 8A is a magnified cross section through 2 embossing elements 800 and 801 that are positioned against each other to produce a pixelized embossed surface (not shown in FIG. 8A). Each embossing element 800 and 801 comprises light scattering elements 802 respectively 803 that slightly protrude from their surrounding surface 804 respectively 805. At the time of pixelization embossing both light scattering elements 802 and 803 come into contact with for example a sheet of paper or innerliner, the thickness of which is greater than a distance separating the light scattering elements from each embossing element 800 and 801, and pixelized embossed structure are formed on the surface of the sheet.

FIG. 8B is an enlarged view from the light scattering elements 802 and 803 out of FIG. 8A, whereby the shape of the light scattering elements as an example are shown to be pyramid with a flattened, cut-off top.

The use of the structures explained in the present section for embossing structures results in embossed materials according to so-called pixelization embossing.

In the present invention the above described light scattering elements, whereby their name specifically refers to their optical properties, will be used in an entirely different context where no use will be made of any of their optical properties. Rather these elements will be part of an adhesion mechanism that is used to make tube shaped closed paper wraps and re-sealable adhesive seals.

In contrast to the previously described prior art of mechanical adhesion theory, the present invention enables an adhesive effect caused by the intertwining or clipping between recesses and protrusions in paper of an innerliner, the recesses and protrusions being made by means of pixelization embossing.

Solid and Re-Sealable Paper Surfaces

The present invention provides an improved strength of connection between two paper or innerliner surfaces to connect, but also a solution for at least two distinct but related problems, i.e., strong and re-sealable paper surfaces connections.

Paper Joint without Discontinuity for Tube Shaped Closed Paper Wraps

Figure 1:
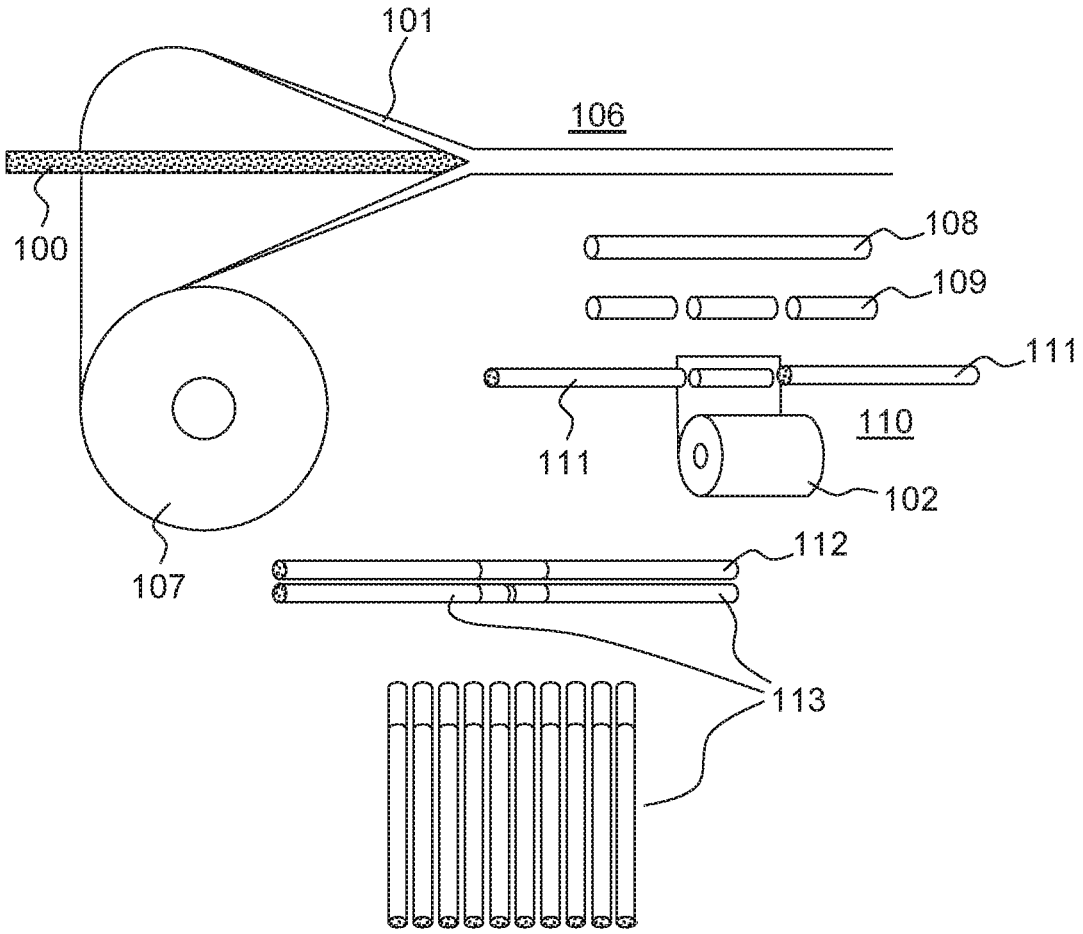
FIG.1 PRIOR ART

FIG. 1 schematically illustrates steps in the manufacturing of cigarettes:

- tobacco 100 is enclosed in a tube-shaped closed paper wrap 101. The wrapping and tube shaping 106 happens using cigarette paper from a paper roll 107;
- a tube of filter 108 is cut in filter sections 109, each one to be used for making two cigarettes;
- in step 110, two tubes 111 intended each for one cigarette are aligned with one filter section 109 and wrapped together with tipping paper 102 also unwound from a roll;
- the resulting tube of two bound cigarettes 112 in then cut in its middle to obtain two cigarettes 113.

A discontinuity in the tube-shaped closed paper wrap 101 may occur where one side of the paper wrap 101 is attached to the opposed side when actually closing the tube-shaped paper wrap.

Figure 2:
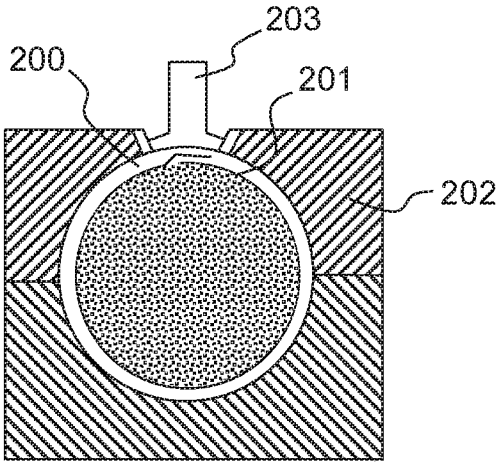
FIG.2 PRIOR ART
FIG. 2 contains a schematic representation of a mold to manufacture joints according to prior art.

Referring to FIG. 2, this shows how the opposed sides 200 and 201 are assembled in a mold 202. The opposed sides may be glued or attached using any other recognized technology, and a lever 203 positions and presses the opposed sides between each other. A discontinuity may occur in joints in tube shaped closed paper wraps, i.e., the part attaching opposed sides 200 and 201, independently from any gluing. The joint represented in FIG. 2 is schematic only and does not reflect with detail an exact result. The discontinuity depends from various factors, such as for example the thickness of the paper and the optional layer of glue 205. Since the thickness of the paper may vary considerably it may not be excluded that the consumer of the cigarette product notices the discontinuity in a tactile manner and unconsciously attributes this comfort parameter in a positive or negative manner.

The invention provides a solution whereby, due to the fact that the depth of connection of two embossed surfaces to be joined for sealing may be pressed as needed using for example the lever 203, i.e., adjusted at the time of the sealing process, the paper joint may be made even, i.e., without discontinuity. This is shown in FIG. 3A, in example cases labeled 1, 2, 3 and 4.

Figure 3A:
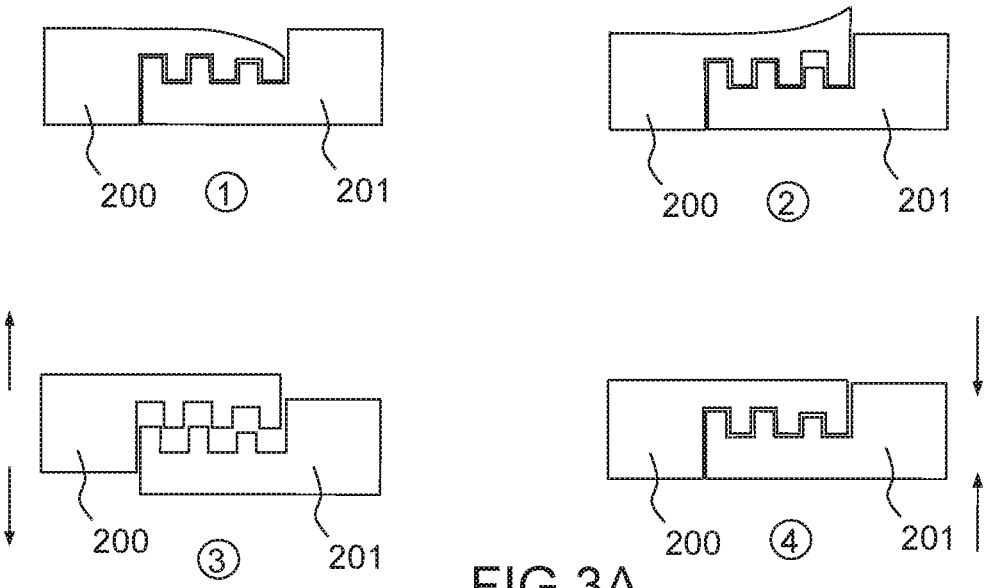
FIG. 3A contains a schematic illustration of joints according to an example embodiment of the invention.

The cases 1-4 in FIG. 3A each show two opposed sides 200 and 201 of the paper wrap, which are each embossed according to the method of pixelization embossing explained in a preceding chapter of the present description. The result of embossing is illustrating in a schematic fashion as teeth and corresponding recesses which intertwine when assembled. This does not necessarily represent the actual result of pixelized embossing, which would rather appear to be an irregular pattern of structures on each surface having a size in a predetermined range of values. Various cases represented include:

- case 1—opposed sides 200 and 201 intertwine but the thickness of side 200 appears to little to avoid discontinuity. Side 201 needs to be pressed by the lever 203—not shown—to correct and eliminate the discontinuity;
- case 2—opposed sides 200 and 201 intertwine but the thickness of side 200 and/or it's embossed structures appear to cause a discontinuity in the joint with side 201. Side 200 needs to be pressed by the lever 203—not shown—to reinforce the intertwining, correct and eliminate the discontinuity;

cases 3 and 4—opposed sides 200 and 201 appears to be correctly dimensioned and to have an intertwining that matches well. The joint of both sides one to another may be adjusted by slightly distancing each side from the other according to the arrows illustrated in case 3, or on the contrary pressing the side towards each other according to the arrows illustrated in case 4—the result being a complete elimination of any discontinuity from the resulting joint.

Figure 3B:
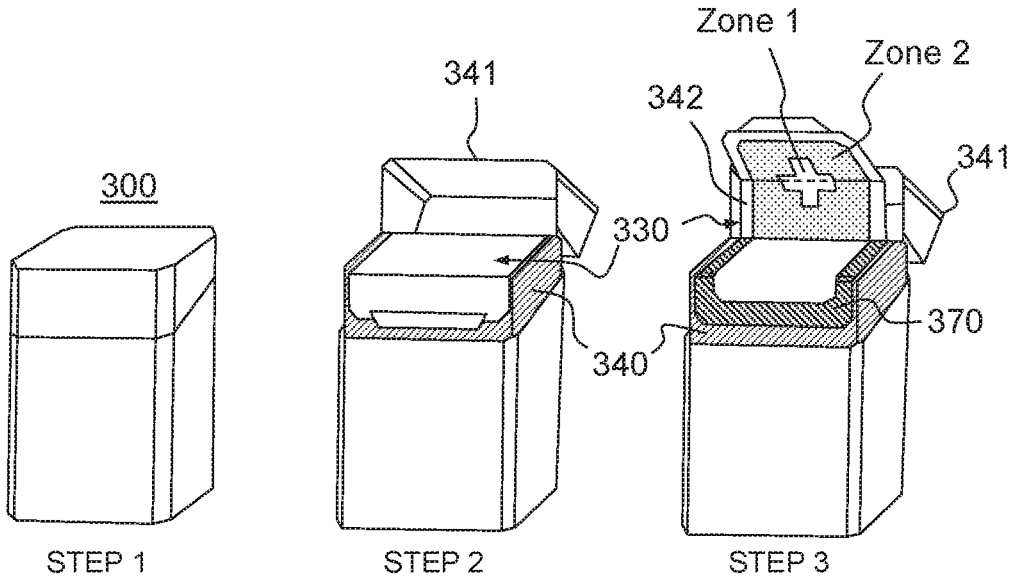
FIG. 3B illustrates a pack of cigarettes according to a preferred embodiment of the invention, in 3 states.
Figure 3C:
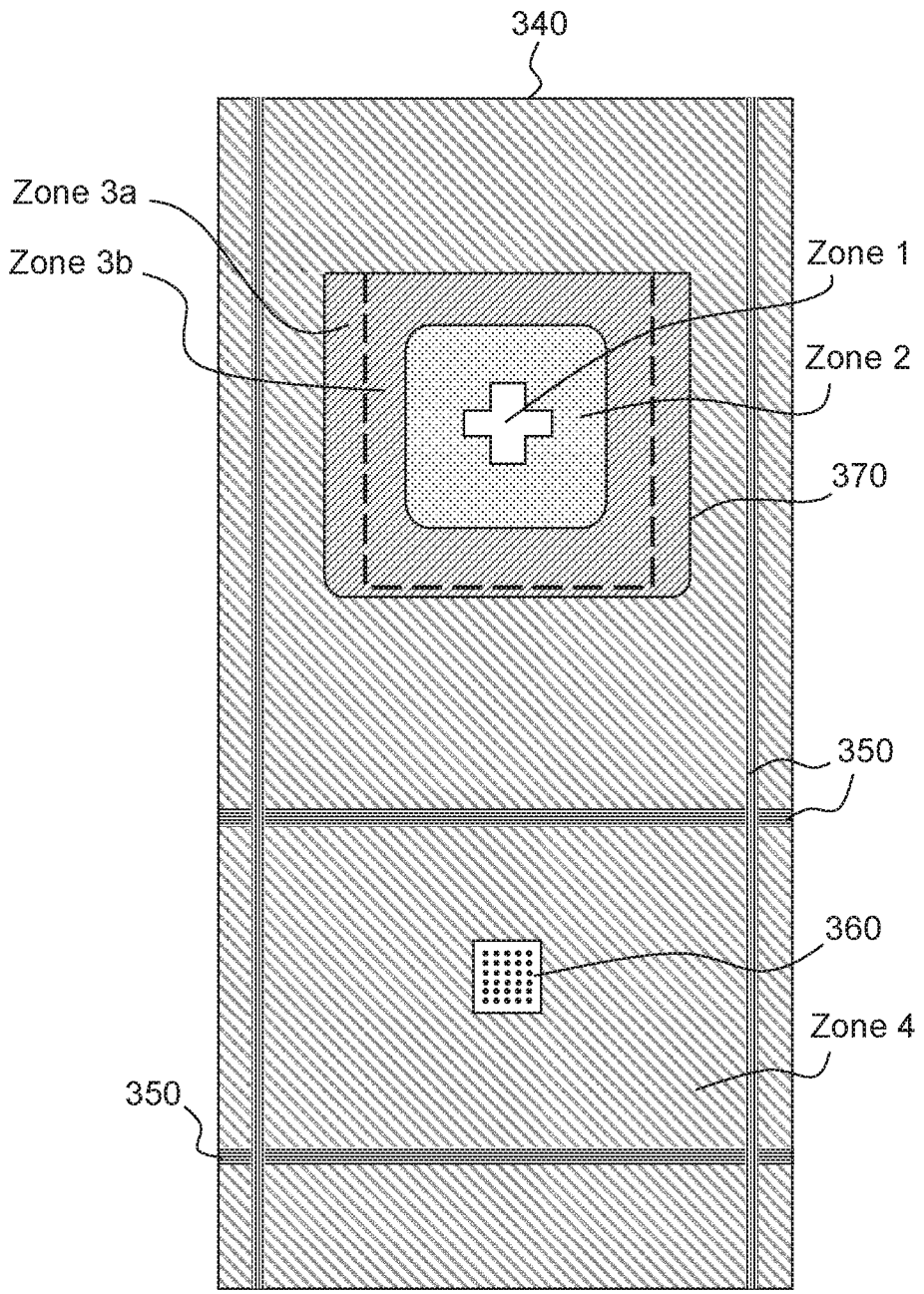
FIGS. 3C-3E illustrate innerliners according to preferred embodiments of the invention.
Figure 3D:
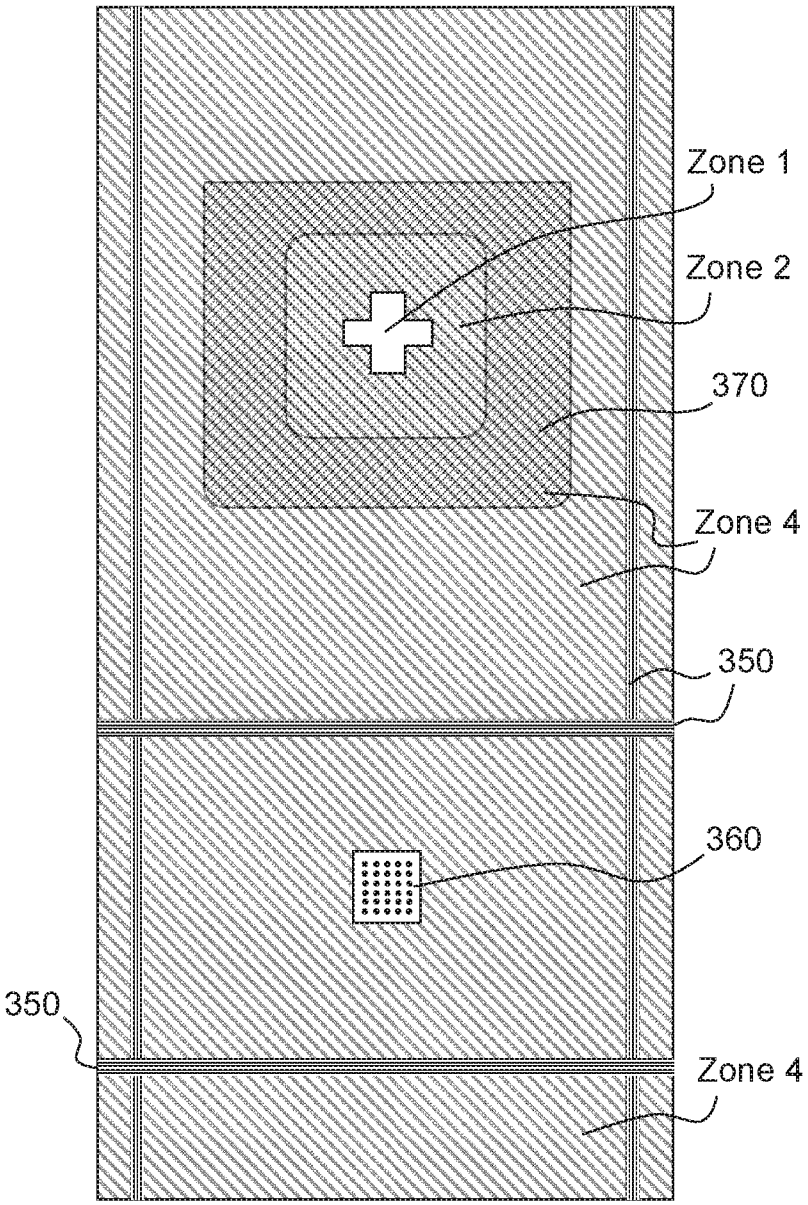
Figure 3E:
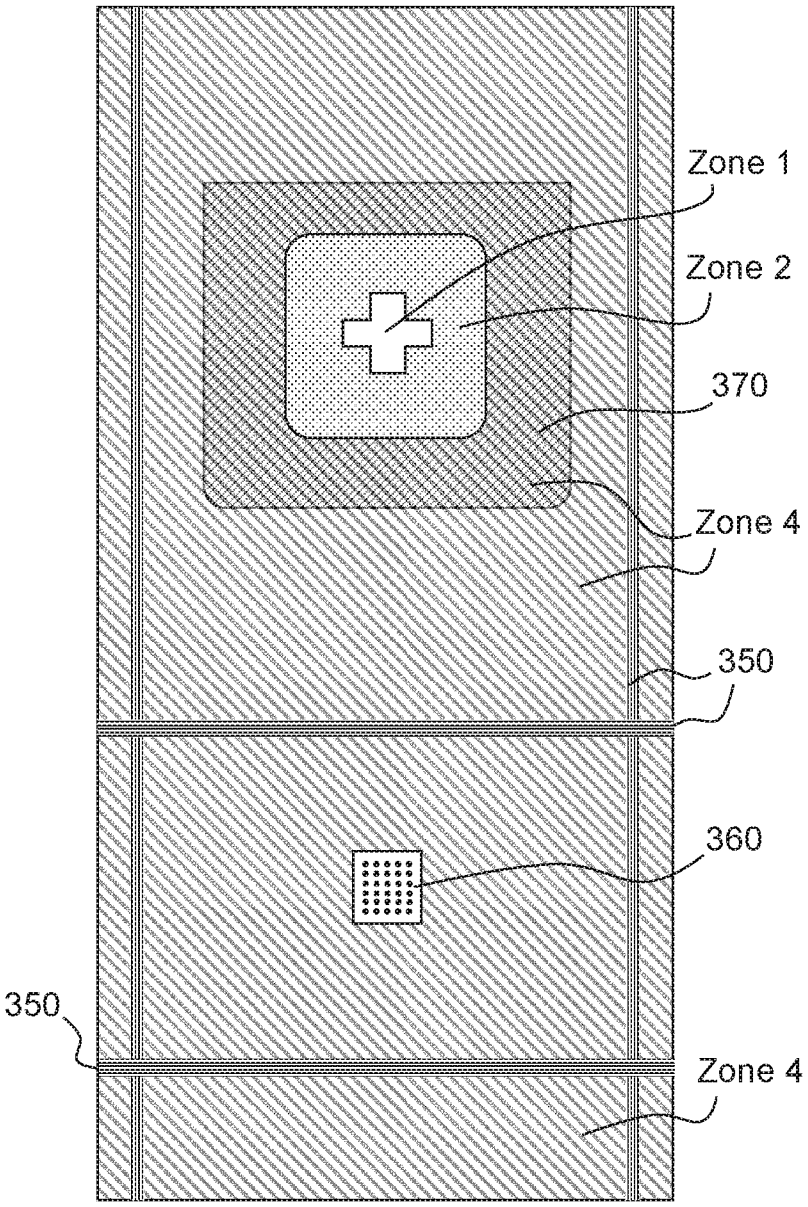
Figure 3F:
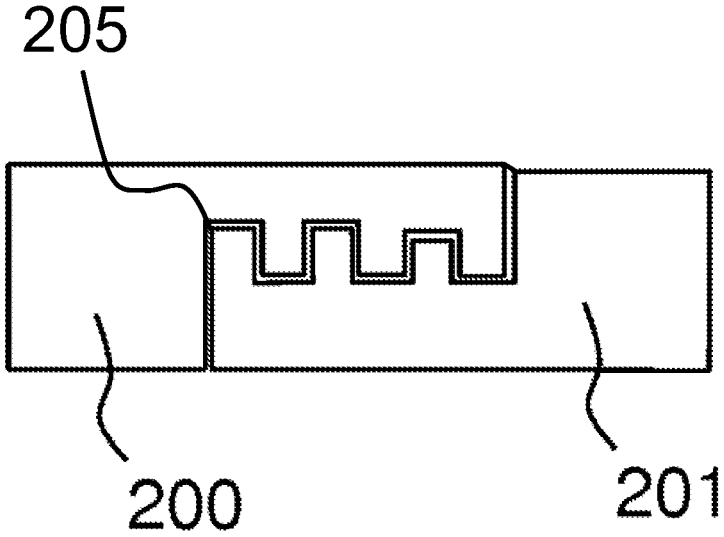
FIG. 3F illustrates a schematic illustration of joints having an adhesive layer or a layer of glue 205 therebetween.

The joint may even be glued as shown in FIG. 3F then adjusted by pressure to remove any discontinuity that may occur.

It is noted that all technical processes of measuring and adjustment required for implementing the fine positioning of the depth of connection may be automatized for a manufacturing process.

Cigaret paper is a type of paper used to enclose the tobacco of the cigarette. Such paper is capable of glowing, is thin and mostly deprived of taste and odor.

The industrial manufacturing of cigarettes makes use of cigarette paper that is made available in 19 to 27 mm wide and 6000 m long rolls on reels. The weight by surface typically may be 15-22 g/m$^2$.

The inventors have surprisingly found by experiment that paper embossed in a pixelized manner makes it possible to have a technical useful adherence.

It is therefore required that the adherence schematically represented in FIG. 3A is realized with paper, preferably cigaret paper, that is embossed according to the pixelization method, using for example tools such as the ones shown in FIG. 7A or 7B, or in FIG. 8A or 8B.

Re-Sealable Innerliner Joints

In the tobacco industry, seals are re-sealable hinged closings, such as they are used in a pack of cigarettes. Such a closing may comprise for example a zone on which adhesive tape is used—implementing known specific adhesives technology—and is situated under the hinged top of the pack. Reference is made to FIG. 3B, where an example of hinged closing is illustrated.

The example illustrated in FIG. 3B shows a re-sealable pack of cigarettes 300, comprising an innerliner 340 used to make the inner packing, and an adhesive label 330. The innerliner 340 has a part that is sticked under the adhesive label 330, and decorated with a logo (zone 1 as seen in FIG. 3B, step 3) which itself is surrounded at least with esthetic embossings in a zone 2. The adhesive label 330 is further bordered by an adherence stripe 342 of adhesive surface that corresponds to borders of the adhesive label 330 going beyond zones 1 and 2, and is sized to cover an opposite sealing surface 370 of the innerliner 340.

In summary, the part of the innerliner 340 that is sticked to the adhesive label 330 comprises:

zone 1 of the logo—the logo is surrounded by esthetic embossings of zone 2, obtained for example according to the teaching obtained from EP 2 842 730;

zone 2—this corresponds to the surroundings of the logo of zone 1, and comprises the esthetic embossings.

The FIG. 3B shows the pack of cigarettes 300 in three steps, step 1—the pack 300 in a closed state;

step 2—the pack 300 with the hinged top 341 of the pack 300 in an open position, but the hinged closing in form of the adhesive label 330 still closed; and step 3—the pack 300 as in step 2, but in addition the hinged closing in form of the adhesive label 330 is in an open position too.

The material used for the innerliner 340 is for example a commercially available weldable innerliner, made from biaxially oriented polypropylene films (BOPP)+aluminum+biaxially oriented polypropylene films (BOPP) layered in this order, and in thickness combinations like the following examples: 20 μm/12 μm/20 μm and 20 μm/9 μm/20 μm.

Prior art closings are described in various publications, and it appears to always be difficult therein to master the aspect of being re-sealable, and more particularly the loss of force of the adherence force and respectively the tightness of the pack of cigarettes. It is for example referred to publications U.S. Pat. No. 5,061,535, WO/EP2013/052909 and EP 2 366637 A1.

In contrast, a combination of the known specific adhesives technologies with the mechanical closing technology according to the invention allows to compensate the loss of adherence that occurs during use of the pack of cigarettes.

In prior art, depending on the structure on the side opposed to the adherence stripe 342, i.e., a sub-zone on the innerliner 340, a default of tightness may occur which is not caused by the general adhesive force but by the plane of the adherence strip 342.

In the following FIGS. 3C-3E, the innerliner 340 is shown in different preferred embodiments, each taken out of the pack of cigarettes 300 and laid out flat. Each figure shows creasing lines 350 which allow a precise creasing of the innerliner 340, an eye mark 360 which is used as a registration feature, and a zone 4, wherein various embossings for esthetically pleasing effects may be made.

In addition each figure shows a part of the innerliner 340 that corresponds to zone 1 and zone 2 already shown in FIG. 3B, step 3, but contrary to this later figure, FIGS. 3C-3E shows these zones seen from a side opposite to the one visible in FIG. 3B, i.e., from the back-side.

In the finished innerliner 340 product, the whole of zones 1 and 2 is for example cut out from the innerliner 340 along the outer periphery of zone 2. Hence when the whole of zones 1 and 2 is sticked on its back-side to the adhesive label 330 (not shown in FIGS. 3C-3E) it separates from the remaining innerliner 340 when the adhesive label 330 is opened (again as shown in FIG. 3B, step 3).

Finally, one further common feature illustrated in each of the FIGS. 3C-3E is the sealing zone 370 of the innerliner 340, which is intended to come in contact with adherence stripe 342 of adhesive label 330 (both not shown in the FIGS. 3C-3E, but shown in FIG. 3B, step 3) when the adhesive label 330 is closed, i.e., sticks on the sealing zone 370.

The sealing zone 370 on innerliner 340 enables the re-sealable closing of the cigaret pack.

As will be explained in more detail in the following, the embodiments illustrated in FIGS. 3C-3E differ amongst each other at least by the manner in which the surface of sealing zone 370 is treated. An other difference illustrated concerns the possibility of decorating the surface of zone 2, but this has no influence on the invention.

FIG. 3C shows a more detailed view of a preferred embodiment of the innerliner 340, in which the sealing zone 370 comprises zones 3*a* and 3*b*. These zones 3*a* and 3*b* are on the innerliner 340, and are characterized by a roughening of the innerliner surface, the intensity of which increases in the transition from zone 3*b* to 3*a*. The roughness of the innerliner surface 3*b* has a mean value in the range from 3

μm to 7 μm, while in zone 3*a* the roughness is in the range of 7 μm up to 12 μm. These roughnesses in some areas, e.g., zone 3*b* correspond to the natural roughness of paper, which may be enhanced, e.g., in zone 3*a,* by usual mechanical methods, such as pixelization embossing, in such a manner that an irregular satinizing is achieved, i.e., randomly distributed surface irregularities.

Figure 9A:
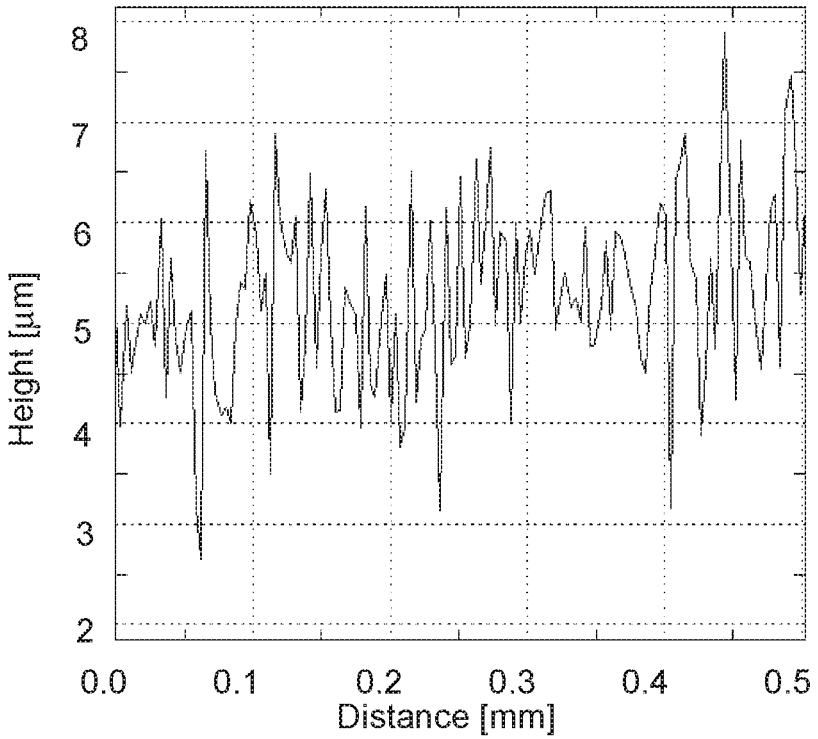
FIGS. 9A and 9B contains an interferometric picture of a surface embossed according a preferred embodiment of the invention.
Figure 9B:
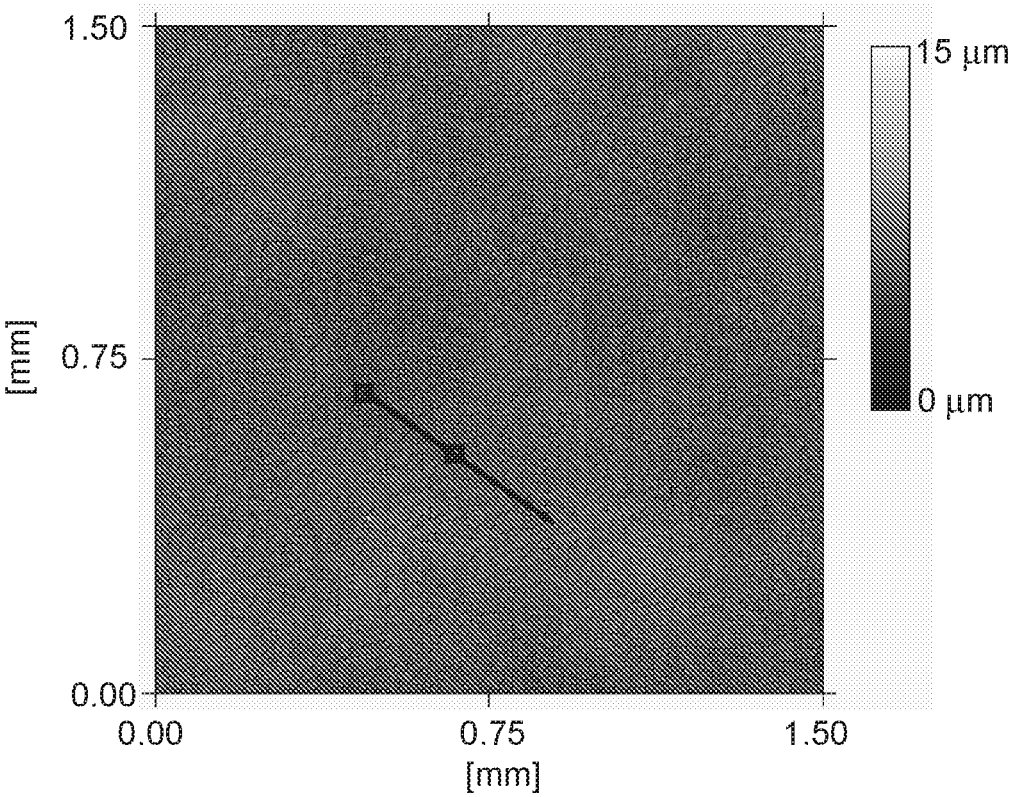
Figure 10A:
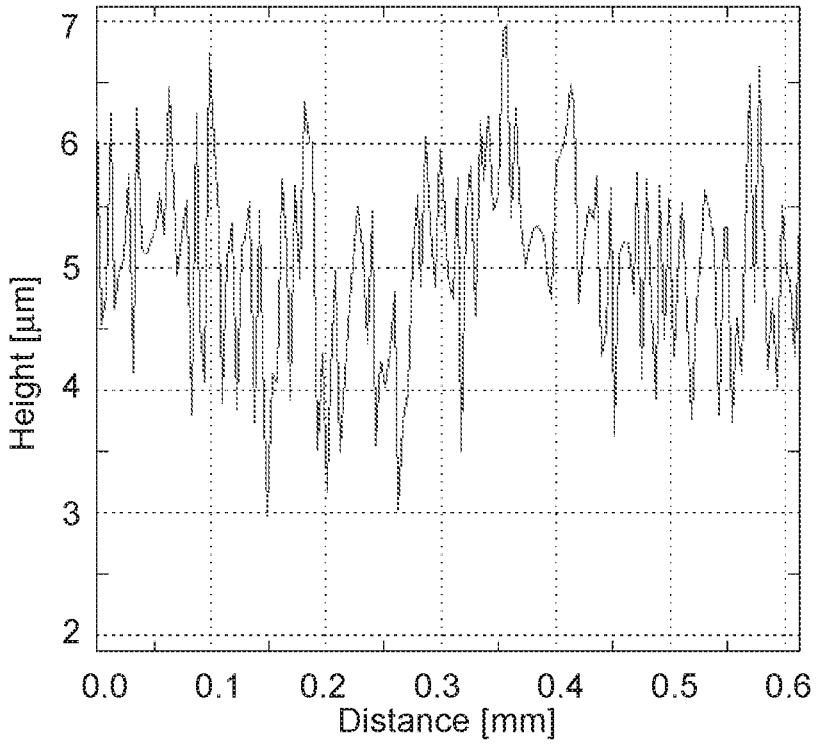
FIGS. 10A and 10B contains an interferometric picture of a surface embossed according a preferred embodiment of the invention.
Figure 10B:
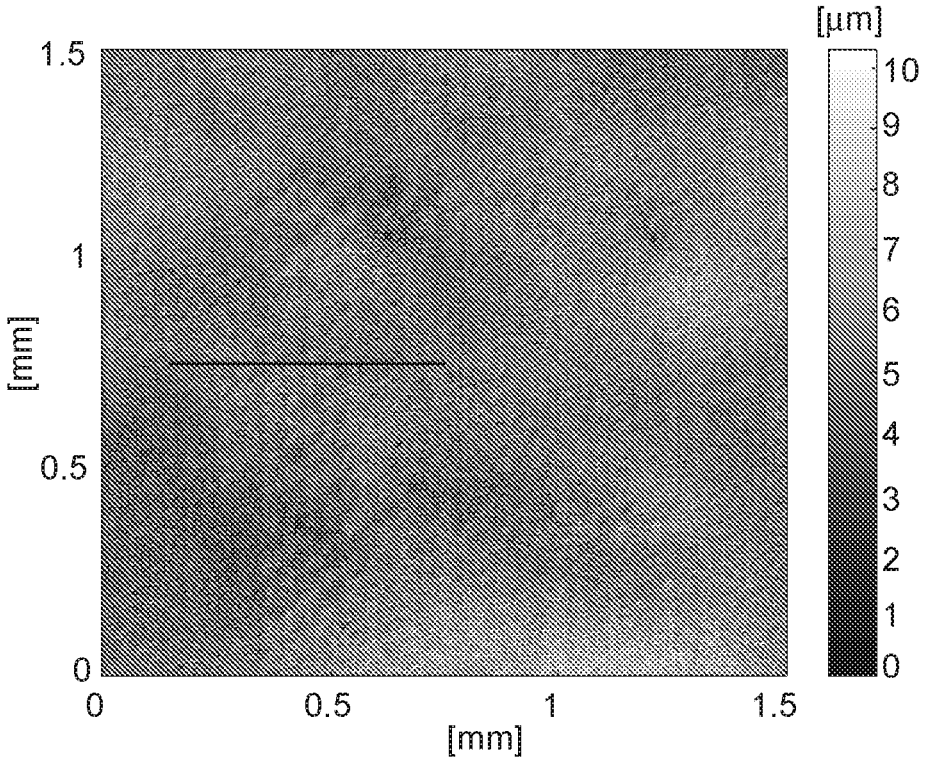

Reference is now made to FIGS. 9A and 9B as well as FIGS. 10A and 9B for examples of the roughnesses. FIG. 9B shows a picture of a POBB surface used to make zone 3*b,* the picture being the result of a white light interferometer measurement. The picture allows to determined roughnesses of the surface. An absence of roughness is represented in black while the range of roughness depicted may go up to 15 μm which is represented in white. More precisely, looking along the segment drawn in the picture, it is possible to quantitatively measure the roughness of the surface along this line—this is illustrated in the graph of FIG. 9A. The graph shows a range of amplitude for the roughness values of about 4 μm. This corresponds to the range indicated herein above in the present paragraph. FIG. 10B shows a picture of a POBB surface used to make zone 3*a,* i.e., a part of sealing zone 370 of the innerliner 340 intended to be situated under the adhesive label 330. A similar measurement is made as in FIG. 9B, along the line segment shown in the interferometer picture, and the graph of FIG. 10A shows the profile of the surface along this line, which appears to have a slightly larger range of values than that of FIG. 9A.

Referring again to FIG. 3C, the adherence stripe 342 of the intended adhesive label 330—not shown in FIG. 3C—roughly covers zones 3*a* and 3*b* of the innerliner 340, i.e., sealing zone 370. The effective adhesive sealing area is the U-shaped border zone 3*a*.

FIG. 3D shows a more detailed view of a preferred embodiment of the innerliner 340, in which the sealing zone 370 is embossed in a similar manner as zone 4 and zone 2. Preferably the embossing is obtained according to pixelization embossing to achieve an efficient re-sealable closing together with adhesive label 330—not shown in FIG. 3D.

FIG. 3E shows a more detailed view of a preferred embodiment of the innerliner 340, in which the sealing zone 370 is also embossed as in FIG. 3D, in a manner similar as zone 4. However zone 2 is embossed in a different manner to achieve a determined esthetic effect.

In a particularly efficient preferred embodiment, not illustrated in the figures, a repeated tight sealing (re-sealable effect) is enabled by structures obtained by making a pixelization embossing by means of the tool of FIG. 7B.

It has been found that the use of pixelizing embossing tools on innerliner allows to overcome adherence problems from prior art and achieve improved re-sealable closings.

The use of cigarette paper embossed using pixelizing embossing tools also allows to make tube shaped closed paper wraps that have a paper joint without discontinuity.

Of course, the inventive structures and methods may also be used to join paper without discontinuity or make re-sealable paper or innerliner seals for other uses as appropriate, such as joining paper sheets which are not necessarily used to make a tube shaped closed paper wrap, or to re-seal for example food packaging, cosmetic packaging.

The invention claimed is:

1. A set of thin foil surfaces configured to achieve a joint between the foil surfaces, the set of the foil surfaces comprising:

a first portion of surface for providing the joint;

a pixelized type embossing on the first portion of surface;

a second portion of surface for providing the joint, wherein the second portion of surface is shaped to correspond to the first portion of surface for making the joint between the first portion of surface and the second portion of surface through contact, the thin foil that provides for the set of thin foil surfaces includes a sheet of paper delimited by two opposed substantially parallel borders, the first portion of surface is located at a first one of the parallel borders, the second portion of surface is located at a second of the parallel borders, the second one opposed to the first one of the parallel borders, and the sheet of paper being configured to form a tube-shaped closed wrapper when the first portion of surface is in contact with the second portion of surface to make the joint.

2. The set of thin foil surfaces of claim 1, wherein the second portion of surface comprises pixelized type embossing, wherein the pixelized type embossing of the first portion of surface and the pixelized type embossing of the second portion of surface are configured to intertwine for providing the joint between the first portion of surface and the second portion of surface.

3. The set of thin foil surfaces of claim 1, wherein the second portion of surface comprises an adhesive layer, wherein the pixelized type embossing of the first portion of surface and the adhesive layer of the second portion of surface are configured to intertwine for providing the joint between the first portion of surface and the second portion of surface.

4. The set of thin foil surfaces according to claim 1, further comprising:

a layer of glue configured to be located on either one of the first portion of surface or the second portion of surface to be positioned between the first portion of surface and the second portion of surface.

5. The set of thin foil surfaces of claim 1, wherein the thin foil is a sheet of paper for a smoking article.

6. The set of thin foil surfaces according to claim 1, wherein the pixelized type embossing have heights in a range of 4 μm to 250 μm.

7. A method for making a joint without discontinuity between surfaces of a thin foil, the thin foil includes a sheet of paper delimited by two opposed substantially parallel borders, comprising steps of:

embossing pixelized type embossing on a first portion of surface of the thin foil, the first portion of surface located at a first one of the parallel borders;

positioning the first portion of surface against a second portion of surface of thin foil, the second portion of surface located at a second one of the parallel borders, opposed to the first one of the parallel borders, to form the sheet of paper into a tube-shaped closed wrapper;

pressing the first portion of surface against the second portion of surface such to achieve the joint; and adjusting a pressure of the pressing to achieve the joint with a thickness substantially the same as a thickness of the thin foil.

8. The method of claim 7, further comprising:

embossing pixelized type embossing on the second portion of surface, wherein the pixelized type embossing of the first portion of surface and the pixelized type embossing of the second portion of surface are configured to intertwine for providing the joint between the first portion of surface and the second portion of surface during the step of pressing.

9. The method of claim 7, further comprising:

providing an adhesive layer on the second portion of surface;

wherein the pixelized type embossing of the first portion of surface and the adhesive layer of the second portion of surface are configured to intertwine for achieving the joint between the first portion of surface and the second portion of surface during the step of pressing, the joint being re-sealable.

10. The method of claim 7, wherein the thin foil is a sheet of paper for a smoking article.

11. The method of claim 7, wherein the pixelized type embossing have heights in a range of 4 μm to 250 μm.

12. A set of thin foil surfaces configured to achieve a joint between the foil surfaces, the set of the foil surfaces comprising:

an inner liner of a package, the inner liner including a first portion of surface for providing the joint, and a pixelized type embossing on the first portion of surface; and a hinged adhesive label including a second portion of surface, the second portion of surface providing the joint and including an adhesive layer, wherein the pixelized type embossing of the first portion of surface and the adhesive layer of the second portion of surface are configured to intertwine for providing the joint between the first portion of surface and the second portion of surface through contact, and wherein the hinged adhesive label is configured to close an opening in the inner liner by the joint.

13. The set of thin foil surfaces of claim 12, wherein the embossing of pixelized type embossing on the first portion of surface is configured such that a mean value of amplitude of roughness of the pixelized type embossing increases from a remote part of the first portion of surface located under the adhesive label remote from a border of the adhesive label towards a border part of the first portion of surface located between the border of the adhesive label and the remote part.

14. A method for making a joint without discontinuity between surfaces of a thin foil, comprising steps of:

providing an inner liner of a package including a first portion of surface of the thin foil;

providing a hinged adhesive label including a second portion of surface of the thin foil and having an adhesive layer;

embossing pixelized type embossing on the first portion of surface of the thin foil;

positioning the first portion of surface against the second portion of surface of thin foil;

pressing the first portion of surface against the second portion of surface such to achieve the joint;

adjusting a pressure of the pressing to achieve the joint with a thickness substantially the same as a thickness of the thin foil; and configuring the hinged adhesive label to close an opening in the inner liner by the joint, wherein the pixelized type embossing of the first portion of surface and the adhesive layer of the second portion of surface are configured to intertwine for achieving the joint between the first portion of surface and the second portion of surface during the step of pressing, the joint being re-sealable.

15. The method of claim 14, wherein the embossing of pixelized type embossing on the first portion of surface comprises increasing a mean value of amplitude of roughness of the pixelized type embossing from a remote part of the first portion of surface located under the adhesive label remote from a border of the adhesive label towards a border part of the first portion of surface located between the border of the adhesive label and the remote part.

16. A set of two thin foil borders, the set of two thin foil borders configured to achieve a joint, the set of two thin foil borders comprising:

a first portion of surface for providing the joint at a first border of the foil;

a first pixelized type embossing on the first portion of surface;

a second portion of surface for providing the joint at a second border of the foil; and a second pixelized type embossing on the second portion of surface, wherein the first pixelized type embossing of the first portion of surface and the second pixelized type embossing of the second portion of surface are configured to intertwine or with each other with corresponding recesses and protrusions of the first and second pixelized type embossing, for providing the joint between the first portion of surface at the first border and the second portion of surface at the second border through contact, to provide a thickness of the joint being the same as a thickness of the thin foil.

17. The set of two thin foil borders according to claim 16, further comprising:

a first opposing side opposite the first portion of surface at the joint; and a second opposing side opposite the second portion of surface at the joint, wherein a thickness of the joint is constant and does not have any discontinuity between the first opposing side and the second opposing side.

18. The set of two thin foil borders according to claim 16, wherein the first border is part of one foil, and the second border is part of another foil, or the first border and the second border are part of a same foil.

* * * * *